United States Patent [19]

Michael et al.

[11] Patent Number: 4,459,917

[45] Date of Patent: Jul. 17, 1984

[54] METHOD AND APPARATUS FOR PRODUCING EVEN TUBE EXTENSIONS IN A PARTIALLY ASSEMBLED HEAT EXCHANGER

[75] Inventors: John E. Michael, Smithville; Larry D. Flatt, McMinnville, both of Tenn.

[73] Assignee: Carrier Corporation, Syracuse, N.Y.

[21] Appl. No.: 412,679

[22] Filed: Aug. 30, 1982

[51] Int. Cl.[3] ..... F28F 9/04

[52] U.S. Cl. ..... 165/151; 29/157.3 R; 29/157.3 C; 72/325; 165/150; 165/178

[58] Field of Search ..... 29/157.3 R, 157.3 C, 29/727, 157.3 B, 157.4, 157.6, 512; 72/325, 294, 479; 165/178, 151, 150

[56] References Cited

U.S. PATENT DOCUMENTS

| | | | |
|---|---|---|---|
| 214,031 | 4/1879 | Edmands | 72/479 |
| 427,240 | 5/1890 | Nason | 29/157.3 R |
| 3,849,854 | 11/1974 | Mattioli et al. | 29/157.3 B |
| 3,972,371 | 8/1976 | Plegat | 29/157.4 |
| 4,125,280 | 11/1978 | Kuzel | 29/157.4 |

FOREIGN PATENT DOCUMENTS

| | | | |
|---|---|---|---|
| 2508921 | 9/1976 | Fed. Rep. of Germany | 29/512 |

*Primary Examiner*—Lowell A. Larson
*Attorney, Agent, or Firm*—Frank N. Decker, Jr.

[57] ABSTRACT

A method and apparatus for appropriately deforming the tube extensions projecting beyond the tube sheet is disclosed. The excess extension material is rolled backwardly toward the tube sheet and slit to prevent catastrophic failure of the extension such that the tube extensions are all configured to extend equidistantly from the tube sheet notwithstanding the fact that they extended various distances depending upon the irregularities of the expansion process. The tooling includes a cylindrical tool having portions for rolling material back towards the tube sheet and spaced teeth for slitting the material to relieve any potential for catastrophic failure.

4 Claims, 10 Drawing Figures

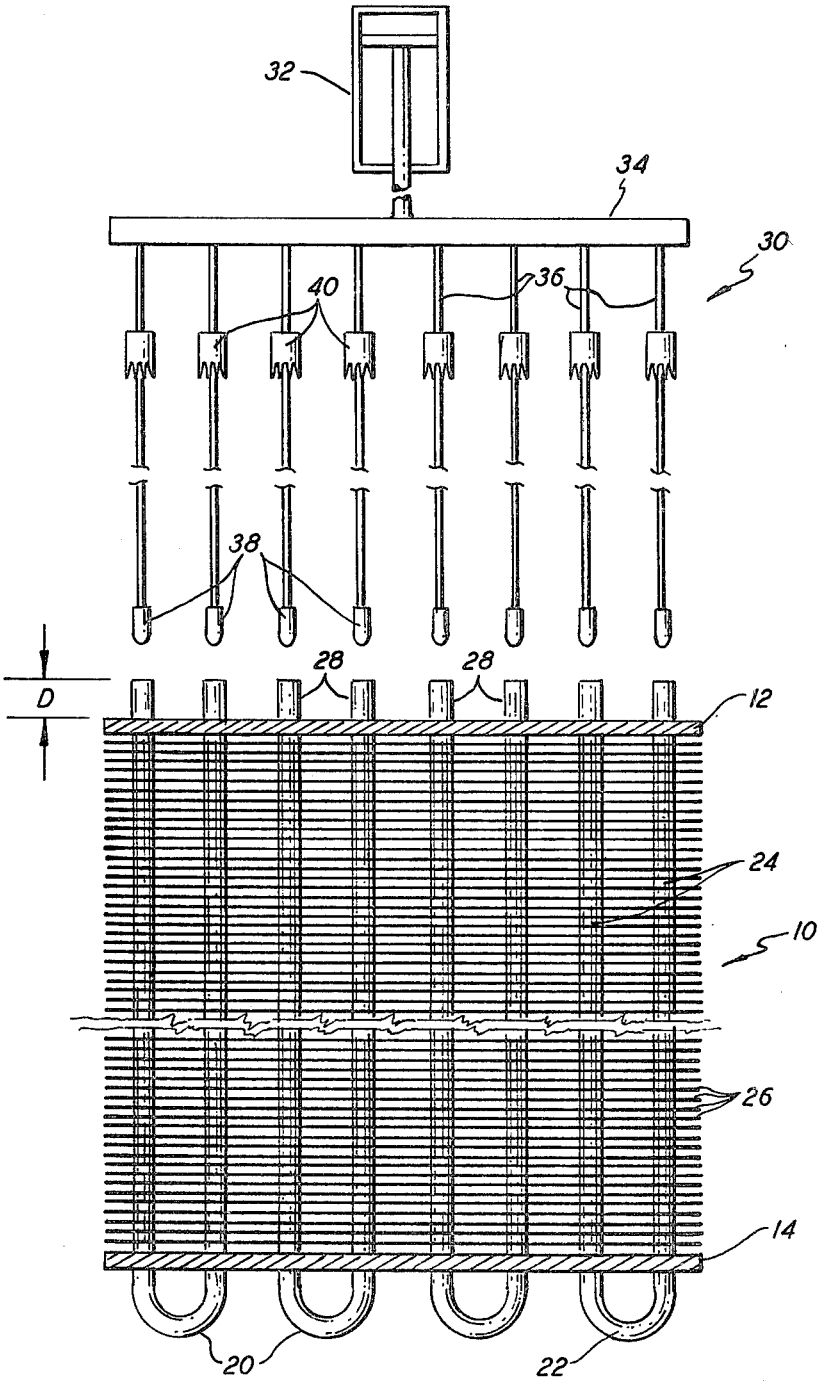
32
34
30
40
36
38
28
28
D
12
24
10
26
14
20
22

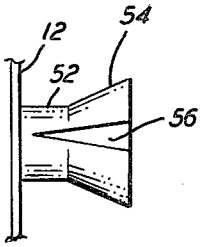
FIG. 5
Prior Art
FIG. 2
Prior Art
FIG. 4
Prior Art
FIG. 3
Prior Art
FIG. 10
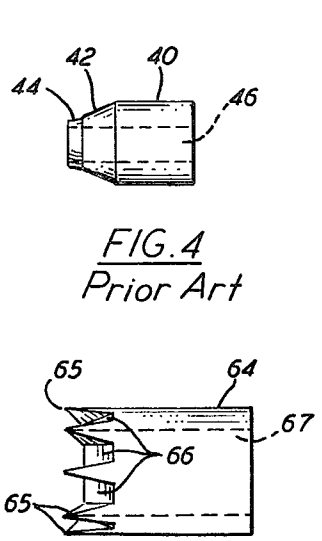
FIG. 8
FIG. 9
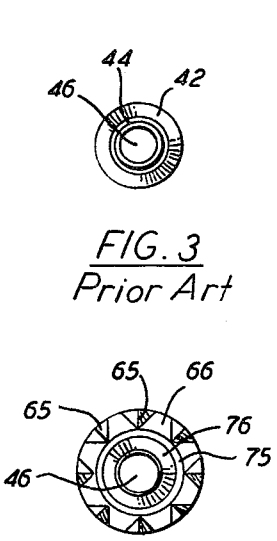
FIG. 7
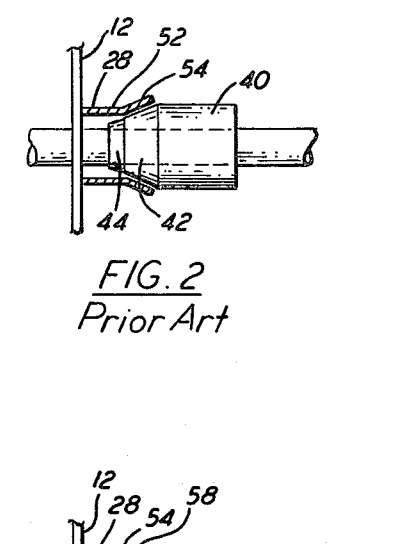
FIG. 6

METHOD AND APPARATUS FOR PRODUCING EVEN TUBE EXTENSIONS IN A PARTIALLY ASSEMBLED HEAT EXCHANGER

BACKGROUND OF THE INVENTION

1. Field of the Invention

The present invention relates to a method of manufacture, tooling and a product produced by the tooling for forming even tube extensions in a partially assembled heat exchanger. More particularly, the present invention concerns the deformation of tube extensions into a cylindrical portion, a flared portion and a separate portion rolled backwardly and slit as it is displaced away from the flared portion to allow the tube extensions to extend equidistantly from a common tube sheet.

2. Description of the Prior Art

In the assembly of plate fin heat exchangers it is known to arrange a myriad of fins each having spaced openings for the receipt of tubes in registration. Heavier tube sheets are placed at each end of the fin bundle formed from the myriad of fins, said tube sheets also having spaced openings for the receipt of tubes. Hairpin or U-shaped tubes are then inserted such that the two legs of the hairpin extend through the fin bundle, through the tube sheets and beyond the tube sheet near the open end of the hairpin. Sufficient hairpin tubes are inserted to fill the spaced openings. The next step in the manufacturing process is to mechanically expand the hairpin tubes such that a metal to metal bond for promoting heat transfer is provided between the exterior surface of the hairpin tube and the fin material defining the opening through which the tube is inserted. One means for accomplishing this expansion is to mechanically force a "bullet" having an outside diameter greater than the internal diameter of the tube through the tube to displace the hairpin tube outwardly to contact the fin material defining the opening.

Once the tubes have been expanded the following step, or one which may occur simultaneously therewith, is to flare the ends of the tube extensions extending beyond the tube sheet. The open ends of the tubes are displaced at an angle outwardly by forcing a flaring tool having a truncated conical face within the open end of the tube. Return bends, being semicircular shaped tubes, are then inserted into the flared portion of the tube extensions with one end of each return bend located within a tube extension of the hairpin tube. The return bends are so arranged such that a fluid circuit is formed through the heat exchanger between the hairpins and the return bends. A securing process such as soldering or brazing is then utilized to secure the return bends to the hairpin tubes to form a fluid tight circuit and substantially complete the heat exchanger.

One of the potential problems that must be overcome during the manufacture of the heat exchanger is the uneven dimensional changes of the heat exchanger during the process of expansion. Depending upon the specific material of the hairpin tube, specific vendor of the tube, the amount of lubricant utilized to promote the bullet traveling through the tube, and other variables the bullets act to mechanically shrink the entire heat exchanger as they are mechanically forced through hairpin tubes of the heat exchanger, with separate hairpin tubes each being shortened a separate amount. Hence, after the tube expansion, that portion of the hairpin tube extending beyond the tube sheet may vary in length. Since these tube extensions vary in length, the subsequent flaring operation may result in excess deformation of a tube extension having excess material.

The heat exchanger is designed to have a portion of the tube extension remain cylindrical for a selected distance from the tube sheet and a portion thereafter flared outwardly for the receipt of the return bend. Should the tube extension be too long then the flared portion becomes longer and longer and the amount of displacement of the tube outwardly in the flared portion becomes great. If the tube extension is too long the entire extension splits as the tube is continuously flared outwardly beyond the point of elasticity of the metal. This split prevents the heat exchanger from being fluid tight until some remedial action is taken. The remedial action might be the replacement of the entire tube or a soldering step to correct the split. In either event, the replacement of the tube or the reworking of the extension is expensive and it is desirable to avoid such a problem.

The herein application is directed towards a method of operation utilizing a tool and the end product produced thereby such that the uneven lengths extending from the tube sheet are all formed such that they extend equidistantly therefrom. The first cylindrical portion of the tube extension remains unchanged and the second flare portion of a predetermined length or diameter is provided. Any tube extension left after these prearranged dimensions which are necessary is accommodated by rolling the tubular material backward toward the tube sheet such that the extension only projects a maximum distance from the tube sheet. To prevent the tube extension from splitting as this material is rolled outwardly and backwardly towards the tube sheet, a series of projections are provided on the tool for slitting the exterior surface of the rolled portion such that the rolled portion has a plurality of spaced slits relieving the potential for catastrophic failure of the tube extension. Additionally, it is contemplated that the previous flaring tool would be mounted on the expander bullet rods together with the bullets for expanding the tubes. The entire assembly would be so arranged that upon the bullets completely traversing the length of the hairpin tube the flaring tool would flare the tube extension and then the entire tooling arrangement would be removed from the heat exchanger. The herein claimed tooling including a portion for rolling back the excess tube extension and slitting same would likewise be mounted directly upon the bullet rod for accomplishing this function.

SUMMARY OF THE INVENTION

It is an object of the present invention to provide a method of manufacturing a heat exchanger having tube extensions extending equidistantly from a common tube sheet.

It is a further object of the present invention to provide a tool for rolling backwardly and slitting excess lengths of tube extensions.

It is another object of the present invention to provide an improved method of manufacture of a heat exchanger suitable for use with existing manufacturing equipment.

Another object of the present invention is to provide a partially assembled heat exchanger having tube extensions projecting equidistantly beyond a common tube sheet.

It is a further object of the present invention to provide a safe, economical and reliable method of manufacture and tool for manufacturing heat exchanger assemblies.

Other objects will be apparent from the description to follow and the appended claims.

These and other objects are achieved according to a preferred embodiment of the invention where there is disclosed a method of deforming the ends of hairpin tubes extending from a fin pack to provide flared tube ends extending equidistantly from a tube sheet for the receipt of return bends. The method includes flaring of a portion of the ends of the tube outwardly with the flared portion being spaced from the tube sheet a selected distance and being inclined outwardly along the tube in a direction away from the tube sheet a flared distance. The method further includes rolling the ends of the tube extending from the flared portion away from the tube sheet back toward the tube sheet such that the tube extends only a predetermined maximum distance from the tube sheet. The method may further include slitting the portion of the tube deformed by the step of rolling to prevent splitting of the tube extension.

A partially formed heat exchanger is further disclosed including a fin bundle formed from a plurality of fins arranged in registration, said fins having spaced openings and a tube sheet located at the end of the tube bundle, said tube sheet having spaced openings arranged together with those of the fin bundle. At least one U-shaped hairpin tube having two tubes extending through the fin bundle and the tube sheet is provided. The ends of the hairpin tube form tube extensions projecting beyond the tube sheet, said tube extensions including a cylindrical portion of a selected length, a flared portion connected to the cylindrical portion and inclined outwardly away from the cylindrical portion and at least some of the tube extensions including a roll back portion extending from the end of the flare portion back toward the tube sheet whereby the length of the roll back portion is adjusted to allow the tube extensions to extend equidistantly from the tube sheet while accommodating hairpin tubes varying in length during assembly of the heat exchanger.

A tool for forming flared, evenly extending ends of tubes extending beyond the tube sheet is further disclosed. The tool comprises a flaring portion having an extending frustrum inclined to flare the tube outwardly as the tool is inserted into the tube and a rolling portion located radially exterior from the flaring portion for bending the portion of the tube flared back toward the tube sheet, said rolling portion including at least one projection extending axially towards the frustrum of the flaring portion and being inclined away from the axis of the rolling portion toward the frustrum of the flaring portion. The tool may further include a series of spaced projections located about the exterior of the rolling portions, each projection having a slitting edge facing radially inwardly for slitting the tube as a portion of the tube is bent backward toward the tube sheet.

BRIEF DESCRIPTION OF THE DRAWINGS

FIG. 1 is a schematic view of a partially assembled heat exchanger arranged in registration with an expander for expanding the tubes of the heat exchanger.

FIG. 2 is a partially sectional view of a prior art flaring tool expanding a tube extension.

FIG. 3 is an end view of the flaring tool of FIG. 2.

FIG. 4 is an isometric view of the flaring tool of FIG. 2.

FIG. 5 is an isometric view of a tube extension which is split because it was overflared.

FIG. 6 is a partially sectional view of an improved tool shown in conjunction with a tube extension.

FIG. 7 is an end view of the tool of FIG. 6.

FIG. 8 is a perspective view of the exterior portion of the tool of FIG. 6.

FIG. 9 is a perspective view of the interior portion of the tool of FIG. 6.

FIG. 10 is a view of the tube extension after deformation with the tool of FIGS. 7–9.

DESCRIPTION OF THE PREFERRED EMBODIMENT

The embodiment herein described will be in reference to a tool designed to be mounted on the rod portion of an expander for engaging the tube extension projecting beyond the tube sheet of the fin bundle. It is to be understood that this tool may be forced into the tube ends in various arrangements to accomplish the same function. It is further to be understood that the method as claimed herein may be accomplished utilizing equipment modified from that as disclosed.

Referring to FIG. 1 there may be seen a heat exchanger 10 having a myriad of fins 26. The heat exchanger has bottom tube sheet 14 and top tube sheet 12. Hairpin tubes 20 are arranged having a return portion 22 and leg portions 24 such that the leg portions extend through the entire fin bundle from tube sheet 14 to tube sheet 12 and extend beyond tube sheet 12 defining extension portions 28. These hairpin tubes are physically inserted through the arranged openings in the fins and tube sheets into the positions as shown. Reference distance D is shown as the distance the extension portions extend beyond tube sheet 12.

Expander 30 is additionally shown in FIG. 1. Expander 30 includes a hydraulic power source 32 for displacing an equalizer bar 34 connected to a plurality of bullet rods 36. One bullet rod 36 corresponds to each leg portion 24 of the hairpin tube such that all of the tubes may be simultaneously expanded. Bullets 38 are mounted on the ends of the bullet rods and have an outside diameter greater than the inside diameter of the tubes forming the hairpins. Also mounted on the bullet rods are flaring tools 40 mounted at an appropriate distance such that when the bullet has traversed the full length of the interior of the hairpin the flaring tool has engaged the tube extension to provide the appropriate end treatment.

In operation the fin bundle, including the fins, tube sheets and hairpins, is arranged in a fixture and the bullets of the expander are then mechanically forced into the ends of the hairpin tubes and down through the tubes expanding them outwardly to promote metal to metal contact between the exterior surface of the hairpin tube leg portions and the interior of the openings defined by the fins and tube sheets. By providing metal to metal contact, heat transfer between the fluid flowing through the tubes and air flowing in heat exchange relation with the fins is promoted. The flaring tools as may be seen are all positioned identically such that they all engage the ends of the hairpin extension portions simultaneously if the hairpin extension portions remain in position. However, the hairpins typically contract or are compacted by the mechanical force required to push the bullets through the tubes such that there is an uneven distance between the tube sheet and the end of the hairpin extension portion as the flaring tools engage the extension portion.

Referring now to prior art FIGS. 2 through 5 it may be seen that flaring tool 40 has an insert face 44 and a flare face 42. It may additionally be seen that tube sheet 12 is shown having hairpin extension portion 28 extending therebeyond. As shown in FIG. 2, there is a straight cylindrical portion of predetermined length 52 and a flared portion 54. This arrangement as shown is the desired arrangement for the insertion of a return bend for affixing to the hairpin tubes to form a circuit through the heat exchanger. Cylindrical flaring tool 40 as shown includes an insert face 44 which fits within the internal diameter of the tube extension and a flare face 42 which forces the tube extension outwardly to form flared portion 54. FIGS. 3 and 4 more particularly point out the rod opening 46 extending through the tool to accommodate bullet rod 36 to which the tool is mounted. FIG. 5 shows a tube extension that had excessive length such that when the flaring tool 40 was inserted such that the straight portion 52 is a desired length the tube was flared much greater than the flared portion 54 as shown in FIG. 2 resulting in split 56 forming in the tube extension. Since this split is located in a portion of the tube which is designed to be part of a fluid tight circuit additional work must be done in order to utilize this heat exchanger once such a split has occurred.

Referring now to FIGS. 6 through 10 there may be seen the improved tool for achieving evenly projecting extension portions of the hairpin tubes. In FIG. 6 there can be seen tube sheet 12 through which the extension portion of the hairpin 28 extends. Again, it may be seen that straight portion 52 of predetermined length and a flared portion 54 also of predetermined length and angle are provided. Connected to and extending from flare portion 54 is rollback portion 58. This rollback portion is the excess length of the extension portion beyond the flare portion. The rollback portion is formed by displacing the excess length of the extension portion back towards the tube sheet such that the overall distance the extension portion projects from the tube sheet is maintained constant. The flaring tool 60 includes an interior flaring portion 62 having insert face 76 fitting within the interior of the tube extension for forming flare portion 54 and a flare face 75 for initiating the rollback of the rollback portion. Tool 60 additionally has an exterior slitting portion 64 being generally tubular in configuration and having a roll face 66 coacting with flare face 75 for promoting the start of the excess material being rolled backwardly towards the tube sheet and has slitting teeth 65 which further act to roll the excess length of the tube extension back towards the tube sheet. The slitting teeth, as may be seen in FIGS. 7 and 8, are projections extending along the exterior of the slitting portion 64. These teeth are wedge shaped, angled radially outward and angled to be inclined outwardly from the tool toward the tube sheet. These wedge shaped projections 65 are spaced about the exterior of slitting portion 64 and have a pointed interior edge. Between the wedge shaped extensions there may be seen roll face 66. The tool is designed such that the interior portions as shown in FIG. 9, has a rod opening 46 and has both an insert face 76 and a flare face 75 and is designed to fit within the interior of the slitting portion 64. Slitting portion 64 has an interior opening 67 into which the interior portion extends.

Referring specifically to FIG. 10 there may be seen a tube extension formed with this tool wherein the tube extension had excess length. As may be seen, extending from the tube sheet is a straight cylindrical portion 52 which is not expanded and a flare portion 54. Connected to flare portion 54 is rollback portion 58. Between segments of rollback portion 58 may be seen slits 59 caused by teeth 65 slitting the material as it is rolled backwardly toward the tube sheet. This combination results in the tube extension being maintained at a particular length with the slits being utilized to absorb the excess deformation beyond the point of elasticity of the material which may result in the entire tube extension splitting similarly to FIG. 5. Hence, by the utilization of this combination of tooling the splitting of the tube extension is avoided.

While the invention has been described herein with reference to a particular embodiment it is to be understood by those skilled in the art that variations and modifications can be effected within the spirit and scope of the invention.

What is claimed is:

1. A method of providing uniform length integral flared portions in the ends of tubes of a heat exchanger for the reception of return bends, which extend equidistantly from a tube sheet of the heat exchanger through which the ends of the tubes initially extend at various distances from the tube sheet, which comprises the steps of:

(A) Simultaneously outwardly flaring the ends of a plurality of cylindrical tubes of uneven distance from the tube sheet by forcing an outwardly flared frustrum into the open end of each of the tubes toward the tube sheet;

(B) stopping the movement of the frustrums toward the tube sheet at a uniformly predetermined distance therefrom, thereby forming and positioning the flared portion of each of the tubes at a uniformly preselected distance from the tube sheet; and (C) slitting and rolling the excess material of the tubes beyond the desired flared portion by contacting and displacing the excess material beyond the desired flare portion with a roll face having slitting teeth disposed thereon, thereby simultaneously slitting and rolling the excess material of the tube backwardly toward the tube sheet while avoiding splitting of the desired flare portion being formed.

2. The method defined in claim 1 wherein the movement of each of the frustrums is stopped a sufficient distance from the tube sheet to leave an unslit integral straight cylindrical tube portion of uniform length between the flared portions of the tubes and the tube sheet.

3. A tool for forming flared evenly extending ends of tubes of a heat exchanger which initially project an uneven distance beyond a tube sheet through which the tubes extend, which comprises:

(A) a flaring portion having an outwardly inclined frustrum for outwardly flaring a tube as the tool is inserted into the open end of the tube;

(B) a rolling portion including a conical surface located adjacent the wider end of the frustrum, said conical surface having an inclination to the axis of the tool greater than the inclination of the frustrum, and being located radially exterior from the flaring portion for bending the excess portion of the tube being flared back toward the tube sheet, said rolling portion further including a plurality of spaced wedge shaped slitting teeth having a slitting edge facing radially inwardly and extending axially toward the frustrum of the flaring portion and being inclined away from the axis of the rolling portion toward the frustrum of the flaring portion.

4. A partially formed heat exchanger which comprises:

(A) a fin bundle formed from a plurality of fins arranged in registration, said fins having spaced openings;

(B) a tube sheet located at the end of the fin bundle, said tube sheet having spaced opening;

at least one U-shaped hairpin tube having two tubes extending through the fin bundle and the tube sheet, the ends of the hairpin tube forming tube extensions projecting beyond the tube sheet; and (C) said tube extensions including a cylindrical portion of a selected length, a flared portion connected to the cylindrical portion and inclined outwardly away from the cylindrical portion, and at least some of the tube extensions including a rollback portion extending from the end of the flare portion back toward and spaced from the tube sheet, the rollback portion being defined by a plurality of segments spaced by a plurality of slits extending axially along the material of the tube roll back portion whereby the length of the rollback portion is adjusted to allow the tube extensions and flared portions to extend equidistantly from the tube sheet without splitting thereof, while accomodating hairpin tubes varying in length during assembly of the heat exchanger.

* * * * *